United States Patent [19]

Reese

[11] Patent Number: 4,548,542

[45] Date of Patent: Oct. 22, 1985

[54] DISPOSAL VEHICLE LOADING APPARATUS

[76] Inventor: Raymond E. Reese, 322 Ave. 17, Los Angeles, Calif. 90031

[21] Appl. No.: 605,146

[22] Filed: Apr. 30, 1984

[51] Int. Cl.[4] ..... B65F 3/04

[52] U.S. Cl. ..... 414/549; 414/409; 414/487; 414/541

[58] Field of Search ..... 414/409, 486, 487, 539, 414/540, 541, 546, 549, 408, 547, 553

[56] References Cited

U.S. PATENT DOCUMENTS

| | | | |
|---|---|---|---|
| 1,780,064 | 10/1930 | Buzzo | 414/541 |
| 2,271,444 | 1/1942 | Schutz et al. | 414/487 |
| 2,456,434 | 12/1948 | Manthie | 414/546 |
| 3,113,685 | 12/1963 | Miller | 414/546 |
| 3,910,433 | 10/1975 | Love | 414/541 |

FOREIGN PATENT DOCUMENTS

| | | | |
|---|---|---|---|
| 104036 | 6/1938 | Australia | 414/541 |
| 201615 | 8/1907 | Fed. Rep. of Germany | 414/409 |
| 206781 | 8/1922 | Fed. Rep. of Germany | 414/409 |

*Primary Examiner*—Robert J. Spar
*Assistant Examiner*—Ken Muncy
*Attorney, Agent, or Firm*—Albert O. Cota

[57] ABSTRACT

A disposal vehicle with a loading apparatus providing a method of lifting a pair of forks from the horizontal portion at the rear of a trash hauling vehicle to directly above its bed. The forks are tilted 90 degrees when positioned on the top of the bed, dumping the contents of a container attached thereto. This is accomplished using a hydraulic system having arm lifting cylinders and bucket emptying cylinders providing the mechanical energy to pivotally lift this pair of arms from the horizontal to the vertical position. Further, a pair of travelers are slideably attached to the arms and have a carriage containing the lifting forks pivotally connected therebetween. After the container has dumped, the carriage returns again following the contour for the vehicle bed rotating the forks simultaneously as it returns to the horizontal position. A pair of securing members pivoted by pneumatic pressure contain entire carriage and fork assembly for over-the-road transportation of the disposal vehicle.

8 Claims, 13 Drawing Figures

DISPOSAL VEHICLE LOADING APPARATUS

TECHNICAL FIELD

This invention relates to vehicles for material or article handling with track guided recepticle supporting carriers in general and more specifically to hydraulic actuated arm extending carriers having lifting forks rotatably disposed on slideably mounted travelers.

BACKGROUND ART

Many and varied methods of loading trash bins into disposal vehicles have been employed. The art is replete with remote structures using hydraulic pressure in cylinders to grasp and lift the bins or containers to the top of the bed and unload the contents inside. In most cases the structures have been limited to using arms or guides apart from the vehicle bed itself. Sexton, Jr. et al in U.S. Pat. No. 2,954,885 teaches such a device with a pair of arms, one distending to the ground and the other pivoted in such a manner as to lift the bin above the vehicle bed, utilizing the contour of the bed for tilting. The same inventor as above, in U.S. Pat. No. 3,012,684 employes a pair of single arms arranged on the front of the vehicle with a slot on a lug holding the container at the end of the arm. A separate hydraulic mechanism tilts the container at the end of the stroke.

Love discloses in U.S. Pat. No. 3,910,433 a trackway detachably mounted to the front end of a truck at the bottom and the truck body at the top using supports. A bucket is mounted upon the trackway and a cable moves the bucket to its emptying position with a rack and pinion arrangement providing the rotation for dumping.

A side mounted hydraulic actuated system is employed in U.S. Pat. No. 4,313,707 issued to Bingham et al wherein a piston and cylinder raise the carriage in guide rails with a chain and a second cylinder dumping the bin held by a pair of gripping arms into the side of the vehicle.

The instant inventor in an earlier U.S. Pat. No. 3,966,067 utilizes a stationary chain fixed within a channel like track extending upwards along the back of the truck and horizontally on the top. A hydraulic gear motor engages the chain and lifts the bin upward dumping with a hydraulic cylinder provided with a second set of controls.

For background purposes and as indicative of the art to which the invention relates, reference may be made to U.S. Pat. No. 3,747,785 issued to Dahlin and Italian Patent No. 571540 of Hanz Zoller.

DISCLOSURE OF THE INVENTION

Many attempts have been made in the prior art to load the bed of a trash hauling vehicle either from the front or the rear. Methods have been devised to tilt the container for emptying when it is positioned above the bed. In most cases the location for dumping is governed by either the arcuate position of the arm, or the shape of the bed interfacing with the container. This art dumps the contents in approximately the same place every time limiting the capacity of the vehicle, as it is dependant upon the angle of repose of the trash itself. It is, therefore, the primary purpose of the invention to provide a loading system that not only lifts the container above the vehicle bed holding the envelope close to the contour, but dumps the load at any point in the interior. This flexibility allows even loading and prevents interference with overhead wires, or low ceilings, etc., in operation. Further, automatic operation of the invention makes it easy for the operator to use with only the selection of where to dump being decided by the operator dependant upon the physical size of each container load. The bucket automatically returns to the horizontal position requiring no further manipulation of controls to accomplish this function.

An important object allows the use of the prime mover as the source of power for the hydraulic system utilizing a power-take-off within the drive train of the vehicle. Also, the disposal vehicle pneumatic system is utilized for secondary functions such as locking the travelers in place for over-the-road transportation. Further, flexibility is realized when using a semi-trailer by applying a separate engine to drive the hydraulic pump.

Another object of the invention relies upon the use of a low pressure return system to restore the bucket to the horizontal position eliminating the possibility of bent cylinder shafts if a restriction occurs.

Still another object restricts the use of chains completely, which have a tendency to become clogged with debris, or jam if they are stretched or bent, further the problem of lubrication is eliminated entirely and only a simple hydraulic ram in the form of a cylinder with a piston is required for complete and automatic operation.

Mechanical safety interlocks comprise yet another object providing safe, simple controls eliminating the possibility of dual operation of the cylinders and unwanted movement during over-the-road transportation.

Finally, a further object provides a minimum of power to operate the system as no redundant drives are required with the energy demand exercised only as needed from the existing vehicle engine or pneumatic system.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
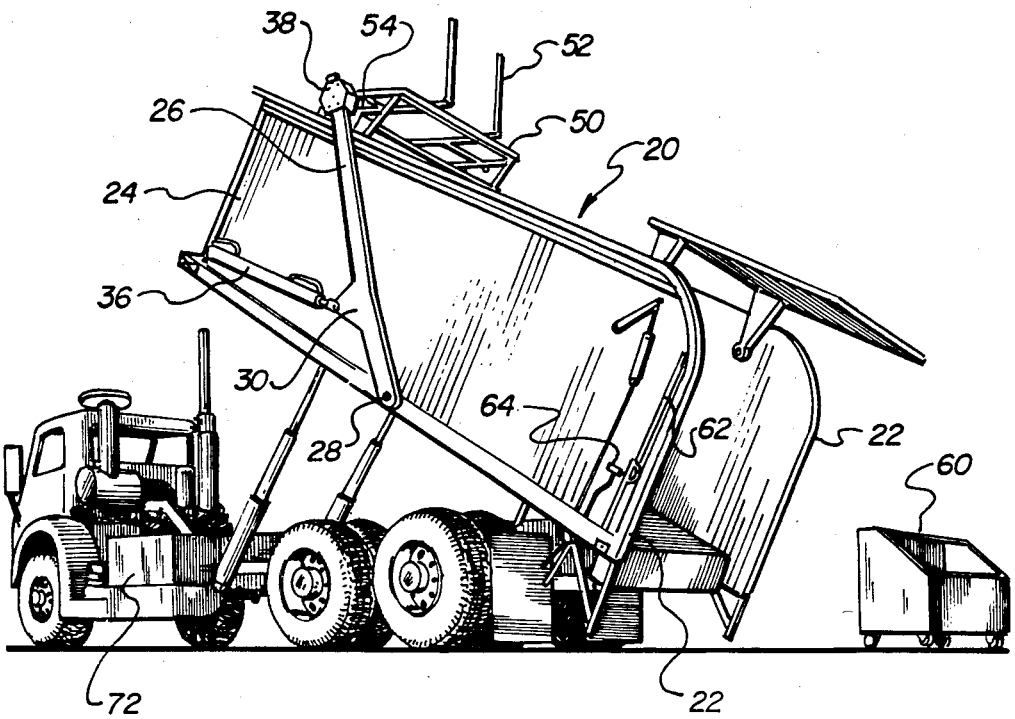
FIG. 1 is an isometric perspective view of the preferred embodiment with the truck bed tilted upward and the back door open with a trash bin or container by the side.

Referring now in detail to the drawings and describing the preferred embodiment, the invention consists of a top loading disposal vehicle 20 having a pair of channel shaped tracks 22 extending on the top of the sides and vertical rear portions of the bed 24. This vehicle 20 may be of any type or style, including 6 or 8 wheel trucks, 8 or 10 wheel semi-trailers, or the like, the trucks having an internal combustion engine as the prime mover. The bed 24 consists of two sides and a front with preferably a full open top and a hinged tailgate or rear door. The channel shaped tracks 22 are continuous from the bottom of the rear portion of the sides radially extending over the rear upper corner to the top integral with the bed itself. Unloading of the vehicle is usually accomplished by a hydraulic ram arrangement tilting the bed upward, but may discharge by any conventional means.

A pair of lifting arms 26 are connected to the bed 24 with swivel pivot pins 28 on each side of the vehicle 20. This pin 28 is centrally located on the bottom rail of the bed 24 allowing the arm 26 to rotate freely about this axis from front to rear. At a position closer to the pivot pin end is a fulcrum bracket 30 which is permanently attached to the arm or is an integral part thereof. This bracket 30 provides an offset extension from the arm 26 at right angles to the plane. At this point the arm may be angularly disposed at the opposite side, depending upon the length of the vehicle bed 24, allowing the end of the arm to be below the horizontal plane. The bottom portion of the arm 26 has a flat edge 32 defining a planar surface upon which a roller may ride. The top portion has an angular edge 34 creating a peaked surface upon which a similarly shaped grooved roller may ride allowing self-centering and alignment.

Figure 2:
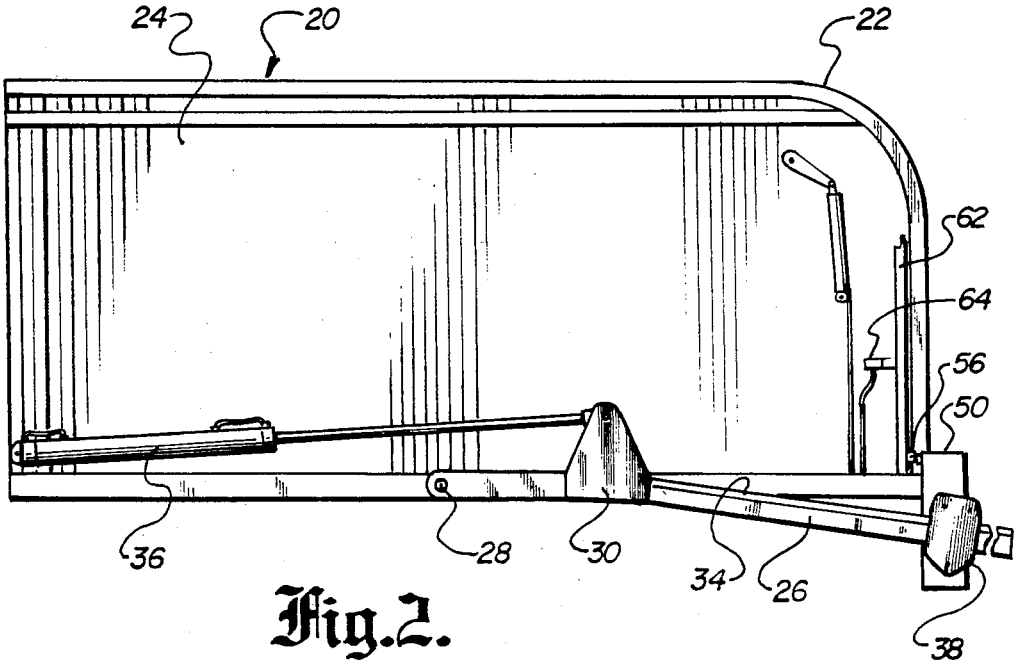
FIG. 2 is a partial elevation view of the road side of the bed of the vehicle with the lifting arm in its lowered position.
Figure 3:
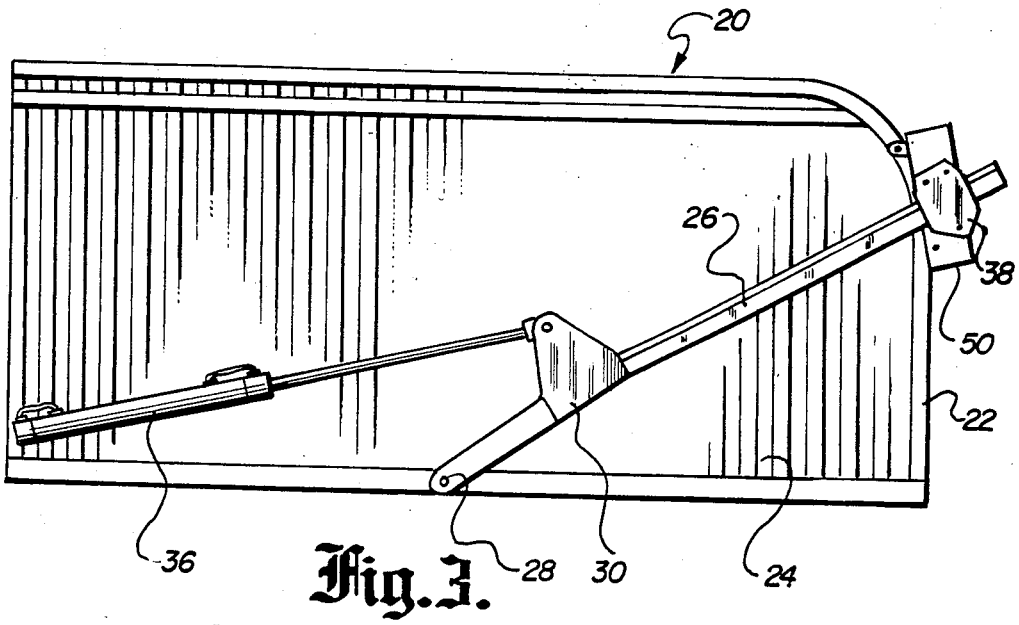
FIG. 3 is a partial elevation view of the road side of the bed of the vehicle with the lifting arm partially raised and the bucket carriage beginning to rotate at the radius of the side wall.
Figure 4:
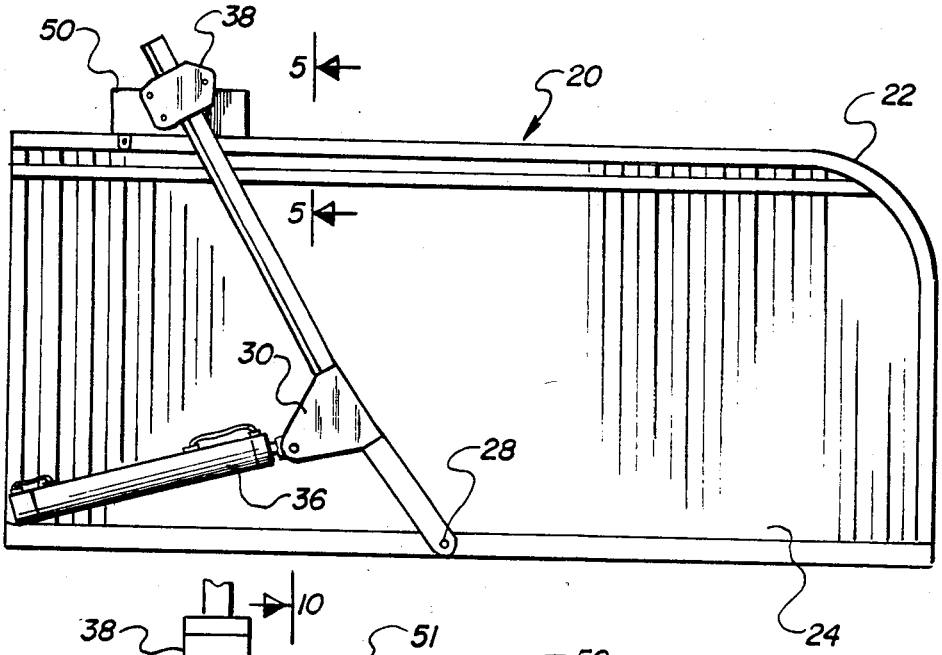
FIG. 4 is a partial elevation view of the road side of the bed of the vehicle with the lifting arm fully extended and the carriage with the forks in tilted position.

FIGS. 1 through 4, 11 and 12 illustrate the movement of the arms 26 as urged by a pair of lifting arm hydraulic cylinders 36. The forward end is pivotally attached to the vehicle bed near the lower edge of the side near the front. The other end is rotatably connected to the fulcrum bracket 30 at the outmost extended edge. FIG. 2 depicts this cylinder in its at "rest position" with the ram extended and the arm 26 horizontal. FIG. 3 indicates movement of the arm 26 upward with the cylinder 36 partially retracted, while FIG. 4 demonstrates the cylinder ram 36 completely withdrawn and the arm 26 forward of the vertical centerline. It will be obvious that the cylinder 36 has complete and infinite control of the position of the arm 26 and may be stopped in any position for dumping along the full length of the vehicle bed 24.

Figure 8:
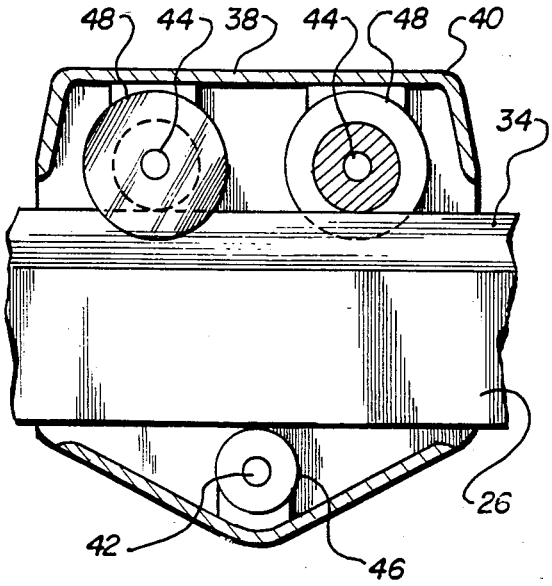
FIG. 8 is a cross-sectional view of the arm traveler depicting the relationship of the rollers to the arm, taken along lines 8—8 of FIG. 7.
Figure 9:
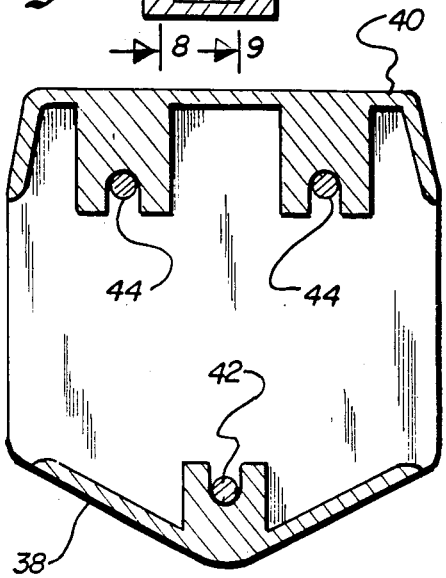
FIG. 9 is a cross-sectional view of the arm traveler taken along lines 9—9 of FIG. 7 illustrating the housing and axles.

Each arm 26 contains an arm traveler 38, best depicted in FIGS. 8 and 9, that is slideably connected having the freedom to move along the entire length of the arms surface. This traveler 38 consists of a housing 40 containing a bottom axle 42 and a pair of top axles 44 that are captivated on each end. A flat roller 46 is rotatably disposed upon the bottom axle 42 and a pair of grooved rollers 48 rotate upon the top axles 44. This arrangement allows the traveler 38 to slideably interface with the arm 26, each individual roller, therefore, providing a bearing contact with its respective surface. It will be noted that the position of the traveler 38 is not linear with the angle of the arm 26, as the contour of the vehicle channel track 22 is followed by the traveler while the arm pivots through its entire stroke. The configuration of the grooved rollers 48 captivates the traveler on the angular edge 34 of the arm 26 maintaining a clearance between the two elements while still providing arrestment thereof.

Figure 5:
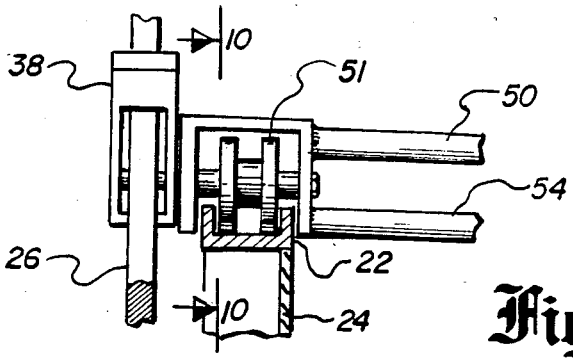
FIG. 5 is a cross-sectional view of the channel shaped track with the bucket carriage wheel engaged thereinto taken along lines 5—5 of FIG. 4.
Figure 6:
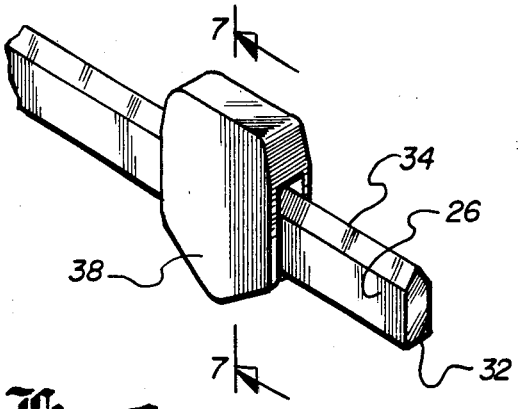
FIG. 6 is a partial isometric view of one of the arm travelers slideably connected to the lifting arm showing the angular edge of the arm on the top surface removed from the vehicle for clarity.
Figure 7:
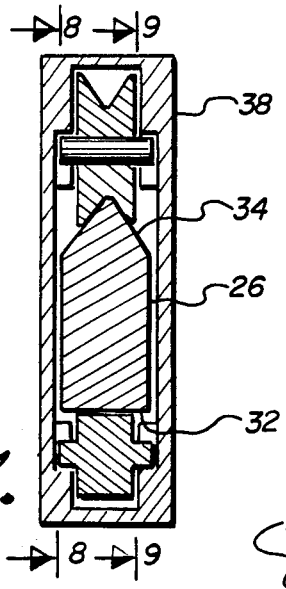
FIG. 7 is a cross-sectional view taken along lines 7—7 of FIG. 6 illustrating the arm traveler housing with the grooved roller on top interfacing with the angular edge of the arm and the flat roller on the bottom.
Figure 10:
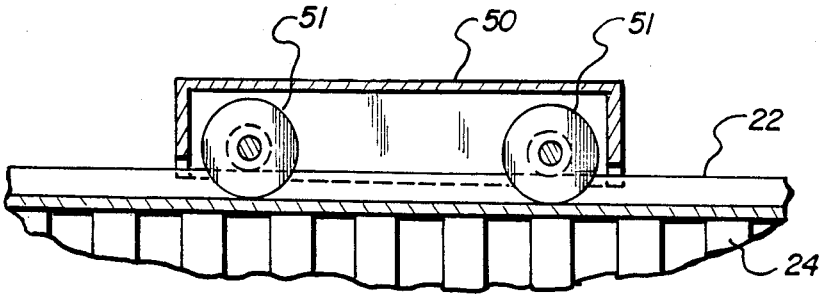
FIG. 10 is a partial cross-sectional view taken along lines 10—10 of FIG. 5 pictorially illustrating the wheels of the bucket carriage upon the channel shaped track of the vehicle bed.
Figure 12:
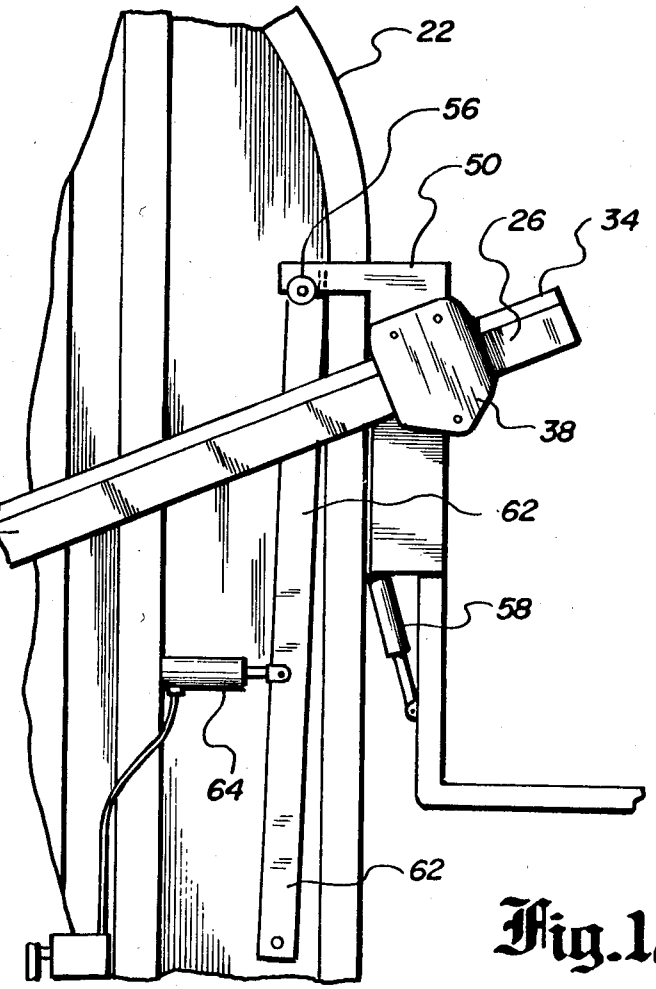
FIG. 12 is a partial road side elevational view with the arm partially raised and the securing member in the actuated position locking the bucket carriage in place for road transportation.
Figure 11:
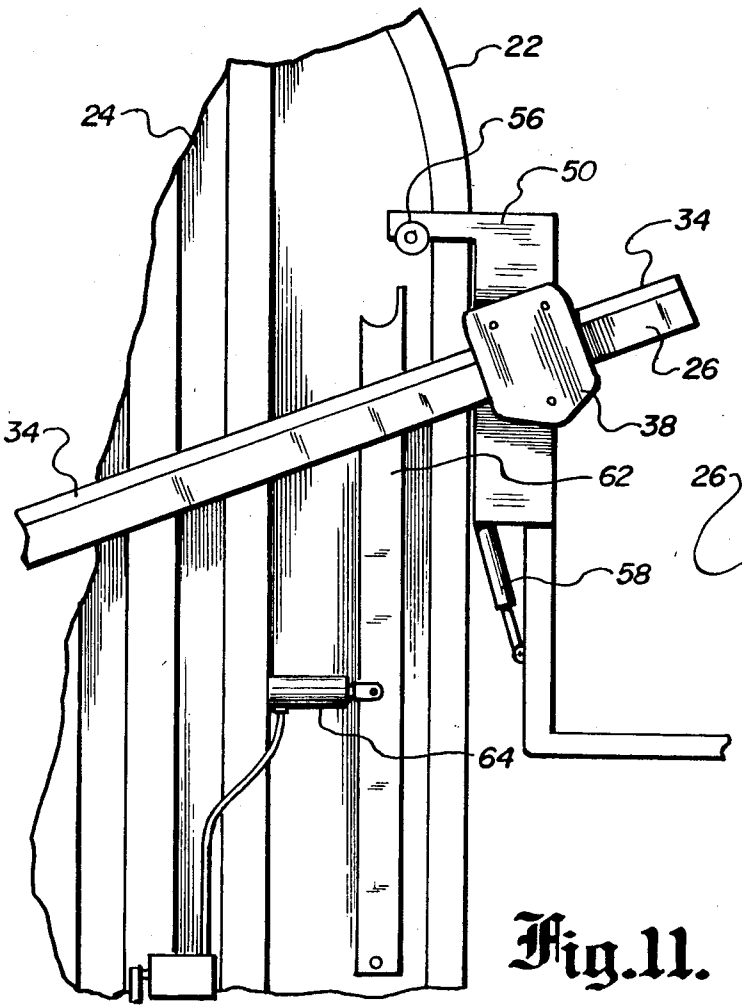
FIG. 11 is a partial road side elevational view with the arm partially raised and the securing member in the deenergized position.

A bucket carriage 50 is formed of structural metallic members spanning the distance between the travelers 38 and rotatably joined on the ends. This junction with the travelers 38 is accomplished on the inside surface allowing axial movement of the carriage 50 while being held captive therebetween. The carriage 50 interfaces with the vehicle bed channel shaped tracks 22 with a plurality of wheels 51, best illustrated in FIGS. 5 and 10. These wheels 51 are mounted in pairs on each side of the carriage 50 and are narrower in width than the channel tracks 22 allowing free rotation when contiguous with the web thereby containing the assembly between the upstanding legs. A pair of lifting forks 52 distend angularly from the body of the carriage 50 and are rotatably joined by pivot pins 54 allowing axial movement of the forks. A plurality of stops, not shown, integral with the carriage body 50 are positioned in such a manner as to allow the forks 52 to rotate from a horizontal plane to a vertical plane within a 90 degree displacement and yet impede any further movement. Finally, a pair of securing disks 56 are disposed on the outside surface of the carriage 50 allowing containment of this carriage 50 for over-the-road transportation.

A pair of bucket emptying hydraulic cylinders 58 are attached on one end to the carriage body 50 and on the other end to the lifting forks 52 allowing the forks to be rotated 90 degrees emptying the contents of a container 60, such as illustrated in FIG. 1, when held by the forks 52.

A pair of pivoted securing members 62 are arcuately affixed to the lower vehicle bed 24 near the rear bottom of each side. The top end of the member 62 is concave in shape fitting the contour of at least half of the securing disk 56. The member 62 is so disposed as to be in alignment when urged forward by a pneumatic cylinder 64 attached on its front edge near the middle. This pneumatic cylinder 64 has the other end attached rotatably to the vehicle bed 24 so that when expanded the disk 56 is captivated by the cavity on the top and when contracted clearing the carriage 50 completely. Pneumatic means, not shown, supply controlled air pressure to the cylinders through a manual valve. The purpose of the securing members is to lock the carriage in position for over-the-road transportation with the pneumatic pressure shared with the air brake system of the vehicle.

Hydraulic means provide the motive force to operate the above hydraulic cylinders starting with a prime mover 68 having a rotational output. The preferred embodiment utilizes a power take off integral with the drive train of the disposal vehicle 20 sharing the same force of the vehicle engine that operates the self-propulsion system.

In another embodiment a separate engine is coupled directly to the system providing independant operation. The latter embodiment is employed particularly when the vehicle 20 is a semi-trailer allowing operation without the tractor being attached, or at least eliminating the problem of attachment of hydraulic lines between the two components.

A hydraulic pump is coupled to the prime mover 58 either directly or through a speed modifying apparatus and consists of a reciprocating piston, rotary, vane type, or any style of pump appropriate for the application capable of supplying pressurized fluid to the system.

A reservoir or storage tank 72 is utilized in the system and is connected at the bottom or sump directly to the intake of the pump 70. The tank 72 provides a source of hydraulic fluid under conditions of surge or aerated return and allows for dissipation of heat built up in the system due to inefficiencies of the pump turning the horsepower into heat in the compression cycle. The pump 70 develops a pressure of perhaps 1800 pounds per square inch (126.56 kilograms per square centimeter) and is connected through metallic piping or high pressure flexible hose to a manual valve 74.

The manual valve 74 is a dual action type having two levers mechanically linked to spools and interconnected internally with each other. The first lever maintains control of raising and lowering of the arms 26 through the cylinders 36 where the second lever controls the bucket emptying of the carriage forks 52. A return line to tank allows control without impeding the flow of fluid from the pump 70.

An electrically energized normally open solenoid valve 76 is fluidly connected to the output of the manual valve 74 and acts as on/off control with a plunger slideably attached to a coil when energized by electrical current from the vehicle system creating an electromagnetic field closing the valve port. The valve 76 is normally open and closes only upon receiving an electrical signal from a limit switch 78 located in conjunction with the manual valve 74 second lever. The switch 76 may be the single pole single throw normally open momentary type.

Figure 13:
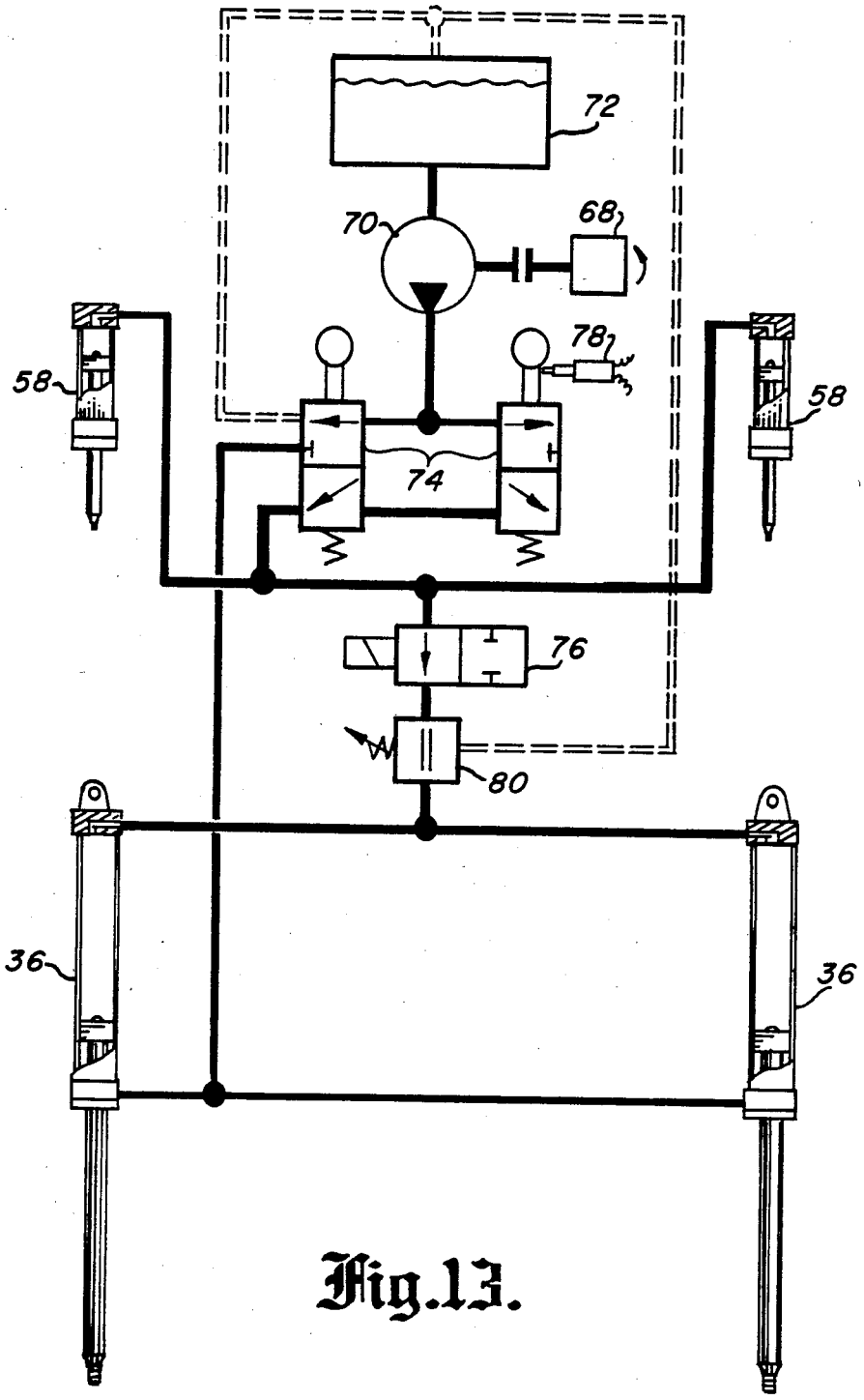
FIG. 13 is a schematic diagram of the hydraulic system illustrating the connection and relationship of the functioning elements.

A pressure regulatory diverter valve 80 is connected at the downstream side of the solenoid valve 74 and acts to reduce the pressure when diverting the flow to tank from the interconnecting hydraulic components, as illustrated in FIG. 13. The valve 80 is sensitive to upstream pressure and regulates this pressure to a predetermined set point on the downstream side. The forementioned reservoir 72 or tank completes the system by receiving fluid from the manual valve 74 and pressure regulating valve 80.

In operation, when the hydraulic pump 70 is mechanically energized a flow of fluid is created from the pump 70 through the manual valve 74 returning to tank 72. Assuming the forks 52 are in the lowered position near the bottom of the vehicle bed 24 by lowering the first lever on the manual valve 74 flow is diverted directly to the lifting arm hydraulic cylinders 36 causing the pressurized fluid to enter the chamber in front of the plunger driving the rod inward causing the arms 26 to raise. The lever is then returned to its normal position when the arm 26 has reached the desired position with the carriage 50 over the bed 24 of the vehicle. The flow then returns to tank 72 as before. When the second lever of the manual valve 74 is lowered the limit switch 78 contact closes energizing the solenoid valve 76 restricting the path back to tank. The flow is, therefore, diverted to the bucket emptying hydraulic cylinders 58, extending the piston, rotating the carriage lifting forks 52, thereby dumping the trash or renderings from the container 60 attached thereto.

In order to return the carriage 50 with the forks 52 to the position at the bottom of the bed 24 only the first handle of the valve 74 is pushed down, this relieves the pressure to the front of the cylinder 36 back to tank 72 and supplies pressure and flow to the back side of the piston forcing the arm 26 downward. This is accomplished with a lower pressure, approximately 200 pounds per square inch (14.06 kilograms per square centimeter), due to restriction of the pressure regulator diverting valve 80 and as gravity causes pressure to increase on the bucket emptying cylinders 58, this simultaneously returns the forks 52 to the normal orientation while simultaneously lowering the entire carriage 50. This action saves the time of the operator and requires only one manual manipulation to accomplish the function and prevents bending the shaft of the cylinders if an obstruction causes it to stick in any position during the lowering process.

Mechanically when the arms are positioned near the bottom of the vehicle bed 24 and the hydraulic system is energized, the lifting arm cylinders 36, being attached to the lifting arm fulcrum bracket 30, retract linearly pulling the lifting arms 26 in an upward and forward direction. The arm travelers 38 being rotatably connected to the bucket carriage 50 follow the contour of the disposal vehicle bed 24 in the channel track 22 along the vertical rear and horizontal top of the sides. The movement continues transporting the forks 52 upward and forward along the top of the bed 24 reaching the desired position where the bucket hydraulic cylinders 58 tilt the forks 52 emptying the contents of the container 60 retained upon the forks 52. In lowering the mechanical reverse procedure is automatically followed with the forks retracting during the travel reaching the horizontal position at approximately the same time the carriage 50 is at the bottom of the travel. A mechanical override safety switch, not shown, is located on the hydraulic control manual valve 74 in such a manner as to physically block the movement of the controls protecting the vehicle 20 from damage of over-travel of the hydraulic system.

To control the speed of the engine when the lifting and dumping procedure is underway, control means in the form of a pneumatic cylinder actuating the engine acceleration system is utilized. This cylinder is operated by a valve and switch located near the operator station with the manual valve 74 using the pneumatic pressure system of the vehicle 20. When the switch is deenergized and the valve is closed, a bleed valve allows the compressed air to escape gradually reducing the engine speed to its normal idle condition.

While the invention has been described in complete detail and pictorially shown in the accompanying drawings, it is not to be limited to such details, since many changes and modifications may be in the invention without departing from the spirit and the scope thereof. Hence, it is described to cover any and all modifications and forms which may come within the language and scope of the appended claims.

I claim:

1. A top loading disposal vehicle having channel shaped tracks on the top of the sides and vertical rear portions of a bed comprising:

a. a pair of lifting arms having a first and second end with a fulcrum bracket disposed closer to the first end than the second end;

b. a pair of lifting arm hydraulic cylinders having a first and second end, the first end pivotally attached to said fulcrum bracket, and the second end connected to said disposal vehicle bed;

c. a pair of arm travelers slideably mounted upon said lifting arms having the freedom to move from said fulcrum bracket to the second end of said arm;

d. a bucket carriage rotatably joined on each end to said arm travelers and slideably connected to said channel shaped tracks on the top and rear of the disposal vehicle having a body with a pair of lifting forks distending angularly therefrom;

e. a pair of bucket emptying hydraulic cylinders attached on one end to said carriage body and on the other end to said lifting forks; and, f. hydraulic pressure means providing the motive force to operate said hydraulic cylinders such that when said forks are positioned near the bottom of said bed, the hydraulic pressure actuates the pair of lifting arm cylinders attached to the lifting arm fulcrum bracket retracting them linearly pulling the lifting arms in an upward and forward direction, the arm travelers being rotatably connected to the bucket carriage follow the contour of the disposal vehicle bed along the vertical rear and top of the sides transporting the lifting forks upward and forward along the top of the bed reaching a desired position where said bucket emptying hydraulic cylinders are hydraulically energized tilting the forks horizontally such that the contents of a bucket attached to said forks would be emptied.

2. The invention as recited in claim 1 wherein said lifting arm further comprises:

a. a pivot pin on said first end rotatably attached to said vehicle providing axial movement of said lifting arm;

b. a flat edge on said arm on the bottom portion defining a planar surface upon which a flat roller may ride; and, c. an angular edge on said arm on the top portion creating a peaked surface upon which similarly shaped grooved rollers may ride for alignment and containment thereof.

3. The invention as recited in claim 1 wherein said arm traveler further comprises:

a. a housing containing a bottom axle and a pair of top axles captivated on each end:

b. a flat roller rotatably disposed upon said bottom axle for interfacing with said lifting arm; and, c. a pair of grooved rollers rotatably disposed upon said top axles to interface with said lifting arm providing said slideable attachment thereof.

4. The invention as recited in claim 1 wherein said bucket carriage further comprises:

a. a pair of wheels rotatably joined to said body on each side having a narrower width than said channel shaped tracks on said disposal vehicle for containment therein;

b. a pair of pivot pins integral with said body rotatably join said lifting forks for axial movement thereof;

c. a plurality of stops contained within said body positioned such that said forks may rotate from a horizontal plane to a vertical plane within a 90 degree displacement; and, d. a pair of securing disks disposed on the outside of said body allow containment of the carriage for over-the-road transportation.

5. The top loading disposal vehicle as recited in claim 1 further comprising:

a. a pair of pivoted securing members arcuately affixed to the opposed rear lower sides of said vehicle bed for securing said bucket carriage in a fixed position as in over-the-road transportation;

b. a pair of securing member pneumatic cylinders rotatably attached on one end to said securing member and on the other to said vehicle bed for movement thereof by expanding contiguously with said bucket carriage and contracting to clear said carriage completely; and, c. pneumatic means to supply controlled pressure to said pneumatic cylinders for actuation thereof.

6. The invention as recited in claim 1 wherein said hydraulic pressure means further comprises:

a. a prime mover having a rotational output;

b. a hydraulic pump coupled to said prime mover rotational output for supplying pressurized fluid as the motive force;

c. a manual valve fluidly connected to said hydraulic pump for diverting flow therefrom;

d. an electrically energized normally open solenoid valve connected to said manual valve;

e. a pressure regulating diverter valve interconnected with said solenoid valve sensitive to upstream pressure regulating to a predetermined set point; and, f. a reservoir tank interconnected with said diverter valve, manual valve and hydraulic pump for receiving hydraulic fluid from said valves and providing a sump to supply fluid to the pump, said pressure means supplying compressed energy to said lifting arm hydraulic cylinders when the manual valve is so positioned and also, to the bucket emptying hydraulic cylinders when the electric solenoid valve is energized in conjunction with manual selection, further the back pressure created by the carriage returning to the lower horizontal position is limited by the pressure regulator diverter valve slowly returning said lifting forks to the working position.

7. The invention as recited in claim 6 wherein said prime mover further comprises: a power take off integral with the drive train of said disposal vehicle sharing the rotational output of the vehicle self-propulsion system.

8. The invention as recited in claim 6 wherein said prime mover further comprises: an engine directly coupled to said hydraulic pump supplying the rotational output necessary for operation independant of any power source on the disposal vehicle itself.

* * * * *